United States Patent [19]

Greenberg

[11] Patent Number: 4,760,958

[45] Date of Patent: Aug. 2, 1988

[54] WATER SPRINKLER

[75] Inventor: Ilan Greenberg, Haifa, Israel

[73] Assignee: Plastro Gvat and Agroteam Consultants Ltd., Ramat Yishai, Israel

[21] Appl. No.: 6,966

[22] Filed: Jan. 27, 1987

[30] Foreign Application Priority Data

Feb. 10, 1986 [IL] Israel ..... 77834

[51] Int. Cl.[4] ..... B05B 3/04; B05B 3/08

[52] U.S. Cl. ..... 239/222.21; 239/DIG. 1; 239/513

[58] Field of Search ..... 239/222.11, 222.13, 239/222.15, 222.17, 222.21, 214, 223, 251, 255, 230–232, DIG. 1, 498, 505, 507, 509, 510, 512, 513, 515

[56] References Cited

U.S. PATENT DOCUMENTS

| | | | |
|---|---|---|---|
| 461,415 | 10/1891 | Bonnette | 239/222.21 |
| 581,252 | 4/1897 | Quayle | 239/222.21 |
| 1,761,422 | 6/1930 | Wagner | 239/512 |
| 1,831,540 | 11/1931 | Nelson | 239/222.21 |
| 2,105,903 | 1/1938 | Clizbe et al. | 239/512 |
| 2,493,595 | 1/1950 | Rieger | 239/DIG. 1 |

FOREIGN PATENT DOCUMENTS

| | | | |
|---|---|---|---|
| 15055 | of 1897 | United Kingdom | 236/222.17 |

*Primary Examiner*—Andres Kashnikow
*Assistant Examiner*—Kevin P. Weldon
*Attorney, Agent, or Firm*—Benjamin J. Barish

[57] ABSTRACT

A sprinkler comprises a nozzle head connectable to a source of pressurized water and including a nozzle bore through which the water issues in the form of a jet, and a rotary deflector having an underface formed with a radial array of grooves each having axially-extending inlet ends, radially-extending outlet ends, curved junctures joining the two ends, and curved bottom faces, which grooves are impinged by the water jet and deflect the jet laterally of the sprinkler while rotating the deflector. An adjustable mounting is provided for the rotary deflector enabling it to be mounted with its rotary axis at a plurality of different positions with respect to the axis of the nozzle bore, to vary the water distribution pattern produced by the rotary deflector laterally of the spinkler.

15 Claims, 3 Drawing Sheets

10a
12
10
10b
4a 10b
4c
10a
10

10
4c
10a
10b 10a
4a
10b
10

10
4a
10b
10a 10
4a
10a
10b 10b
10a
4a
10

10
4a
10b
10a 110a
112
110
116e
116f
116
110b 104a
116
110
110b 104a
116
110b
110

116
104a
110
110b

110

210
216
216
210b

FIG 7
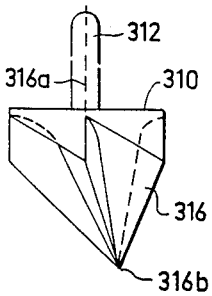
FIG 7a
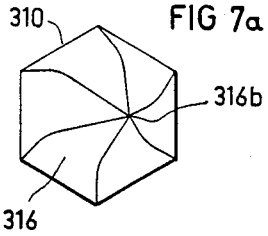
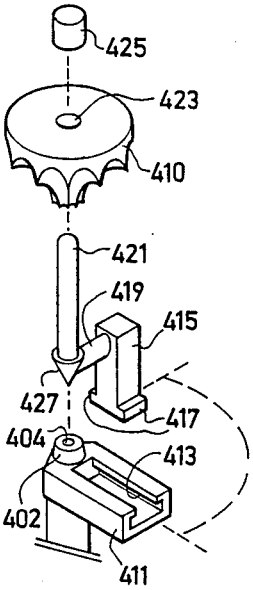
FIG 8
FIG 9
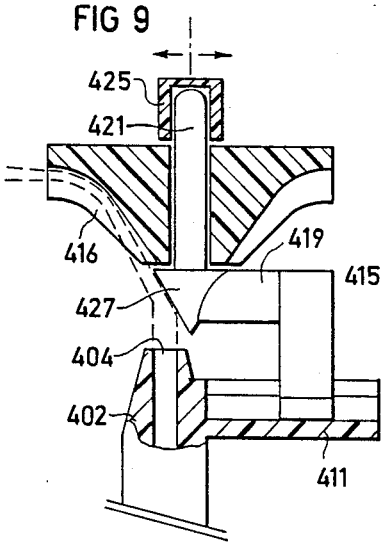
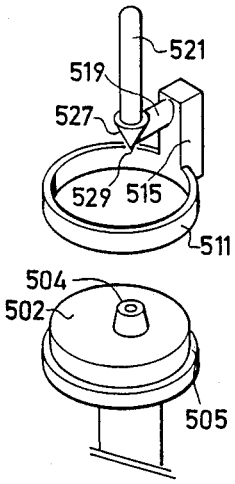
FIG 10
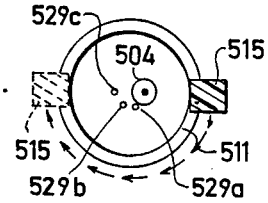
FIG 10a
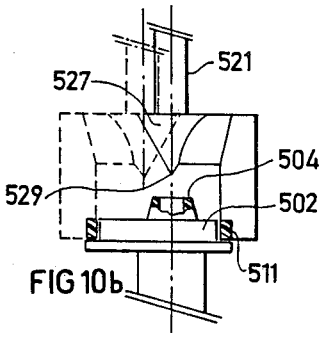
FIG 10b
FIG 11
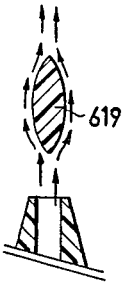

WATER SPRINKLER

RELATED APPLICATIONS

The present application is related to applications Ser. Nos. 07/006,999 and 07/007,105, both filed by the applicant on the same date as the present application and assigned to the same assignee as the present application.

BACKGROUND OF THE INVENTION

The present invention relates to water sprinklers, and particularly to water sprinklers which can be operated either as a sector-type sprinkler to wet only a predetermined sector, or as a conventional full-circle sprinkler.

Sector-type water sprinklers are commonly used where it is desired to distribute the water over a predetermined sector, rather than completely around the sprinkler. The predetermined sector may be, for example, the location of a tree to be irrigated by the water, or the outer edge or corner of a land plot to be irrigated. Many sector type sprinklers have been designed and are now in use, but efforts are continuously being made to simplify their construction so as to permit their manufacture and assembly in volume and at low cost, and also to increase their range under given water pressure conditions.

SUMMARY OF THE INVENTION

An object of the present invention is to provide a new sprinkler constructed of a few relatively simple parts which can be manufactured and assembled in volume and at relatively low cost. Another object is to provide a sprinkler which can be conveniently preset to wet either a full circle or a predetermined sector. A further object is to provide a sprinkler having increased range particularly when operated as a sector-type sprinkler.

According to the present invention, there is provided a sprinkler comprising a nozzle head connectable to a source of pressurized water and including a nozzle bore through which the water issues in the form of a jet; a rotary deflector having an underface formed with a radial array of grooves each having axially-extending inlet ends, radially-extending outlet ends, curved junctures joining the two ends, and curved bottom faces, which grooves are impinged by the water jet and deflect the jet laterally of the sprinkler while rotating the deflector; a supporting member fixed with respect to the nozzle head; and a mounting member carrying the rotary deflector and slidable along the supporting member for positioning the rotary deflector with its rotary axis at a large number of different positions with respect to the axis of the nozzle bore, to vary the water distribution pattern produced by the rotary deflector laterally of the sprinkler.

According to one feature of the present invention, the supporting member comprises a bridge secured to the nozzle head and having a horizontal arm overlying the nozzle, the arm being formed with a slot slidably receiving the mounting member carrying the rotary deflector.

According to another feature of the present invention, the mounting member comprises a vertical post laterally of the nozzle bore and slidable along the supporting member; a horizontal arm secured at one end to the upper end of the vertical post to overlie the nozzle bore; a vertical pin secured to the opposite end of the horizontal arm; and a juncture between the horizontal arm and the vertical pin, the juncture being of conical configuration having its apex oriented towards the nozzle bore.

A sprinkler constructed in accordance with the foregoing features may be constructed of a few simple parts, and may be conveniently preset to distribute the water completely around the sprinkler or only in a predetermined sector. Moreover, the described arrangement, including the radial array of grooves, produces a wetting pattern of increased range, as compared to other sector-type sprinklers, because the water is channeled within the grooves as they pass the nozzle bore to concentrate the water into a plurality of streams, one produced by each groove, as the grooves rotate past the nozzle bore.

The invention permits a wide degree of variations with respect to the configuration and dimensions of the array of grooves in order to obtain any desired wetting pattern. Thus, the grooves may all be of the same dimensions; alternatively, some of the grooves may be wider than others and thereby produce streams containing more water and therefore of longer range. In addition, the deflector may be of circular cross-section or of polygonal cross-section.

Further, the adjustable mounting may permit adjustment of the rotary deflector in the radial direction with respect to the nozzle bore, or in the circumferential direction.

Further features and advantages of the invention will be apparent from the description below.

BRIEF DESCRIPTION OF THE DRAWINGS

The invention is herein described, by way of example only, with reference to the accompanying drawings, wherein:

FIG. 5 illustrates the operation of the sprinkler of FIG. 1, FIGS. 5*a*–5*c* showing the sprinkler preset to produce a full-circle water distribution pattern, whereas FIGS. 5*d*–5*g* show the sprinkler preset to produce a sector pattern, the sector being as illustrated in FIG. 5*h*;

FIG. 6 illustrates a symmetrical-rotary deflector which may be used in the sprinkler of FIG. 1, FIG. 6*a* being a bottom plan view of the rotary deflector of FIG. 6, FIG. 6*b* illustrating the vertical water distribution pattern produced by the sprinkler of FIG. 6, FIG. 6*c* illustrating the horizontal water distribution pattern, FIG. 6*d* illustrating how that pattern can be conveniently changed by varying the position of the rotary deflector with respect to the nozzle, and FIG. 6*e* illustrating a modification in the construction of the grooves in the sprinkler of FIG. 6.

FIG. 7 illustrates another non-symmetrical type of rotary deflector which may be used, FIG. 7*a* being a bottom plan view;

FIG. 8 is an exploded perspective view illustrating another sprinkler construction in accordance with the invention;

FIG. 9 is an enlarged view illustrating the operation of the sprinkler of FIG. 8;

FIG. 10 is a perspective view illustrating a further sprinkler construction in accordance with the invention, but with the rotary deflector omitted;

FIGS. 10*a* and 10*b* are diagrams illustrating the manner of adjusting the mounting of the rotary deflector in the sprinkler of FIG. 10 for changing the water distribution pattern; and FIG. 11 is a diagram illustrating the shaping of the mounting of the rotary deflector to provide a smooth hydrodynamic surface at the portion of the mounting in the path of the water deflected laterally from the deflector in order to eliminate the interruption that would otherwise be produced by the impingement of the laterally-deflected jet against This mounting.

DESCRIPTION OF PREFERRED EMBODIMENTS

Figure 1:
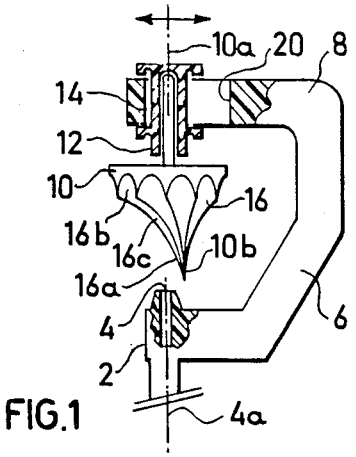
FIG. 1 is a side elevational view, partly in section, illustrating one form of sprinkler constructed in accordance with the invention.
Figure 2:
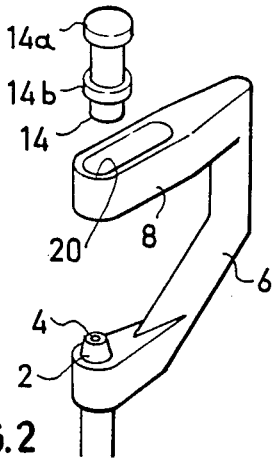
FIG. 2 is an exploded perspective view illustrating the sprinkler of FIG. 1 without the rotary deflector.

The sprinkler illustrated in FIGS. 1 and 2 comprises a nozzle head 2 connectable to a source of pressurized water (not shown) and including a nozzle bore 4 through which the water issues in the form of a vertical jet. Nozzle head 2 carries a bridge 6 formed with an arm 8 overlying nozzle bore 4.

A deflector 10 includes a vertically-extending stem 12 rotatably received within a mounting member 14 carried by an arm 8, such that the underface of the deflector is impinged by the jet issuing from nozzle bore 4. The underface of the deflector 10 is formed with a radial array of grooves 16 each having a curved bottom face, and an axially-extending inlet end 16*a* joined to a radially-extending outlet end 16*b* by means of a curved juncture 16*c*. Each of the grooves 16 is further formed at its exit end 16*b* with a deflector wall 16*d* (FIG. 3*a*) which is impinged by the jet exiting from the groove. The arrangement is such that the grooves receive the jet leaving nozzle bore 4 in an axial direction and deflect the jet to the horizontal direction laterally of the sprinkler and at the same time rotate the deflector.

The rotary deflector 10 is of a non-symmetrical construction with respect to its rotary axis. Thus, as seen particularly in FIGS. 4 and 4*a*, the center axis 10*a* of the deflector 10 is coaxial with its stem 12, but the tip 10*b* of the grooved underface of the deflector is displaced laterally of the central axis 10*a*.

Mounting member 14 receiving stem 12 of the rotary deflector 10 is adjustable along the length of arm 8 of bridge 6. For this purpose, arm 8 is formed with a slot 20, and mounting member 14 is formed with a pair of annular ribs 14*a*, 14*b* engageable with the opposite surfaces of arm 8 to permit the mounting member to be manually slid to any desired position along the length of slot 20 and to be retained in position by the friction between the contacting faces of mounting member 14 and arm 8.

Figure 3:
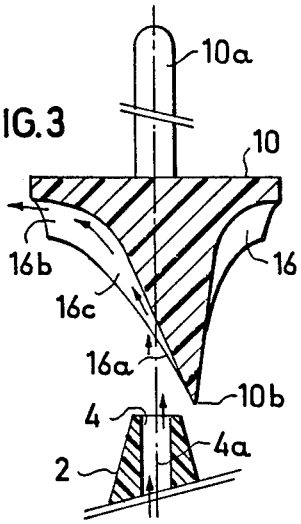
FIG. 3 is an enlarged fragmentary view of the sprinkler of FIG. 1
Figure 3A:
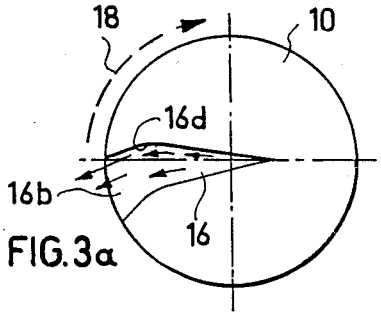
FIG. 3*a* is a diagram helpful in understanding its operation.
Figure 4:
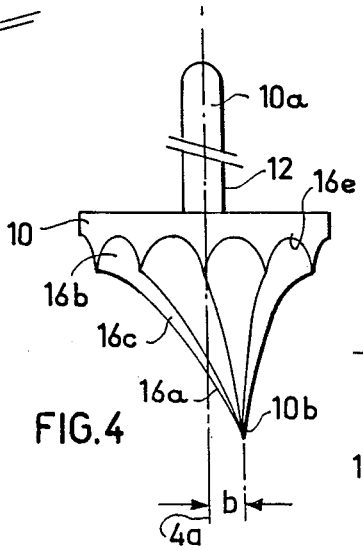
FIG. 4 is a side-elevational view illustrating the rotary deflector of FIG. 1.
Figure 4A:
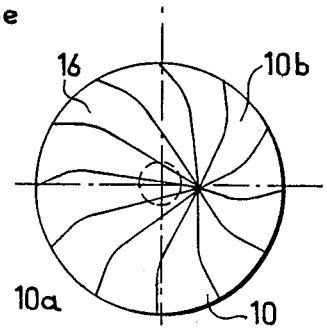
FIG. 4*a* is a bottom plan view of the deflector.

In the arrangement illustrated in FIGS. 1–4, the rotary axis of deflector 10 is adjustable in the radial direction with respect to nozzle bore 4. Thus, FIGS. 3, 4 and 4*a* illustrate the position of the rotary deflector 10 when its rotary axis 10*a* is aligned with the nozzle bore axis 4*a*; in this case, the conical apex 10*b* at the underface of the deflector is disposed laterally to one side of the bore axis 4*a*. By thus presetting the rotary axis 10*a* of deflector 10 with respect to the nozzle axis 4*a*, various water distribution patterns may be produced, from a full-circle distribution to a predetermined sector distribution.

Figures 5, 5A, 5B, 5C, 5D, 5E, 5F, 5G, 5H, 6, 6A, 6B, 6C, 6D, 6E:
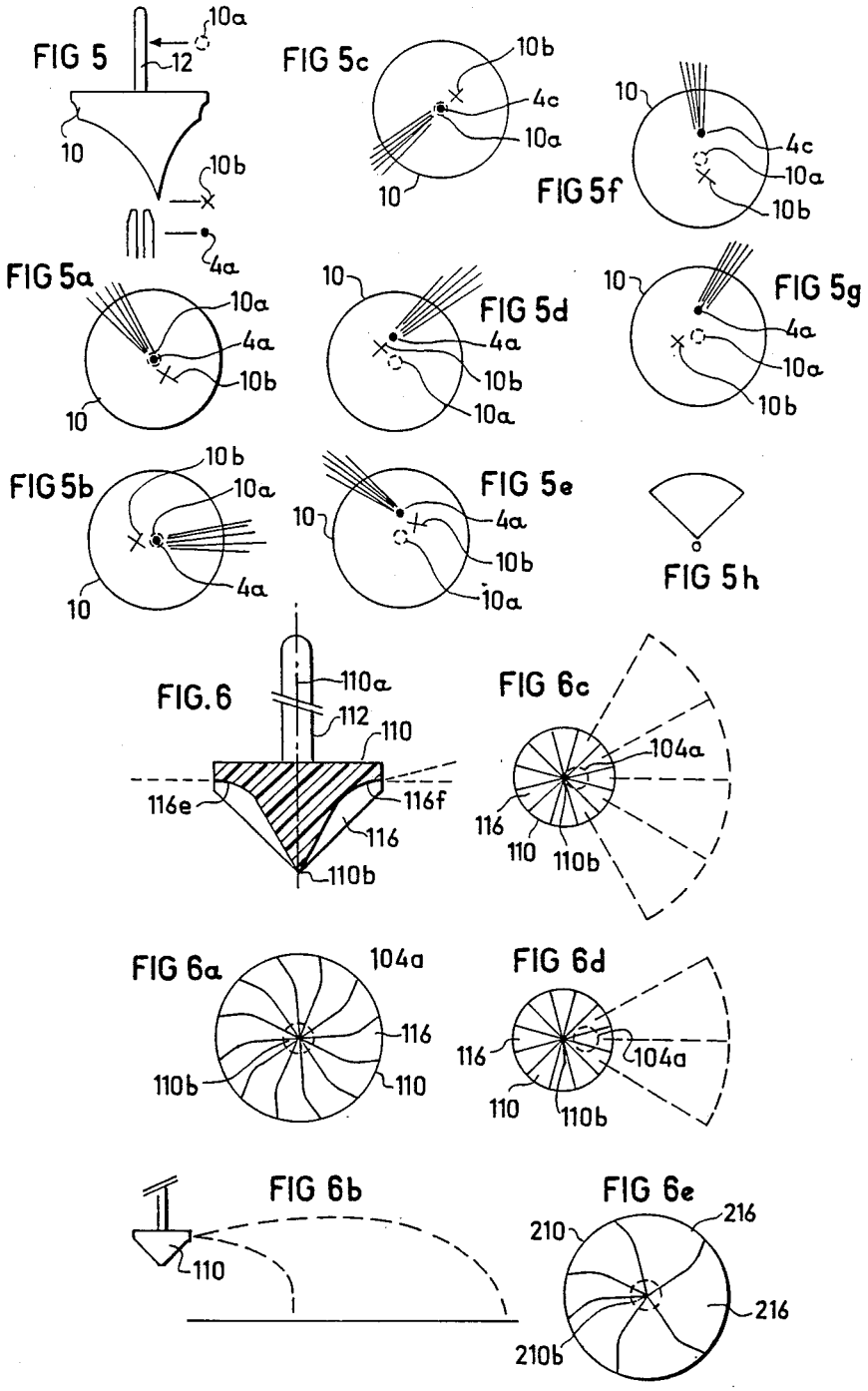

FIG. 5 illustrates the rotary deflector 10 with its rotary axis 10*a* aligned with the nozzle axis 4*a*, and with the apex 10*b* of the grooved underface disposed laterally to one side of the nozzle axis 4*a*. Such a disposition of the deflector will produce a complete 360° rotation of the deflector, thereby producing a full-circle distribution pattern as shown in FIGS. 5*a*, 5*b* and 5*c*.

FIGS. 5*d*–5*g* illustrate the arrangment wherein the deflector 10 is preset with its rotary axis 10*a* laterally to one side of the nozzle axis 4*a*; the conical apex 10*b* of the grooved underface is also laterally of the rotary axis. In such a case, the deflector 10 will rotate 360°, but the water will be distributed over an arc of less than 360° as shown in FIGS. 5*d*–5*g*, to produce a water distribution pattern over a predetermined sector, as shown in FIG. 5*h*.

Thus, the arrangement illustrated in FIGS. 1–4 may be preset, by adjusting the position of socket 14 along the length of arm 8, to produce a water distribution pattern extending for a full-circle around the sprinkler, or for only a predetermined sector of the full circle at one side of the sprinkler.

FIGS. 6 and 6*a* illustrate a modification wherein the rotary deflector, therein designated 110, is of symmetrical configuration; that is, its conical apex 110*b*, at the underface formed with its grooves 116, is coaxial with its rotary axis 110*a*, defined by its stem 112. The mounting of rotary deflector 110 may be the same as described above with respect to FIGS. 1 and 2, namely including a socket receiving its stem (112) and adjustably mounted in a slot formed in the mounting arm, corresponding to socket 14, slot 20 and mounting arm 8 in FIGS. 1 and 2.

In such an arrangement, when the rotary deflector is preset such that the apex 110*b* of its underface (and thereby also its rotary axis 110*a*) is aligned with the axis 104*a* of the nozzle bore, a full-circle water distribution is produced. However, by presetting the deflector such that its apex 110*b*is off-center with respect to the nozzle bore axis 104*a*, a sector water distribution pattern is produced. The angle of the sector depends on the degree of off-set of the deflector apex 110*b* with respect to the nozzle axis 104*a*; the larger is the off-set, the smaller is the sector, as shown in FIGS. 6*c* and 6*d*.

FIG. 6 illustrates a further variation that may be included in the rotary deflector. Thus, the outlet ends of the grooves 116 on one side of the deflector are oriented so as to be substantially horizontal as shown at 116*e*, whereas the outlet ends of the grooves 116 on the opposite side of the deflector are inclined slightly upwardly as shown at 116*f*. The water streams leaving the groove ends 116*e* will be substantially horizontal, whereas those leaving the groove ends 116*f* will be inclined slightly upwardly. This arrangement produces the vertical wetting pattern illustrated in FIG. 6*b*, which results in a more uniform distribution of the water when compared to a conventional wetting pattern wherein all the streams exit from the deflector grooves in substantially the horizontal direction.

FIG. 6*e* illustrates a further variation which may be included in the deflector, therein designated 210. In this variation, the grooves 216 are dimensioned differently to change the water distribution pattern. Thus, the grooves 216 at the right side of the conical apex 210*b* are formed in substantially larger sectors than those at the left side of the deflector, so that the grooves at the right side will receive more water than those at the left side and will therefore distribute the water over a larger range.

FIGS. 7 and 7*a* illustrate a further variation in the construction of the deflector, therein designated 310. In this variation, the deflector 310 is not of circular cross-section, as in the previously described embodiments, but rather is of polygonal cross-section. In this case, the deflector is formed with seven sides, each side constituting the outlet end of one of seven grooves 316 formed in the underface of the deflector. The deflector illustrated in FIG. 7 and 7*a* is of the non-symmetrical type, with its conical apex **316*b* displaced laterally from its rotary axis 316*a* defined by its stem 312**.

FIG. 8 illustrates a variation in the construction of the adjustable mounting of the rotary deflector, therein designated 410, with respect to its nozzle head 402. In the arrangement illustrated in FIG. 8, the nozzle head 402 carries a supporting member in the form of a horizontal arm 411 formed with a slot 413 adapted to receive the lower end of a mounting member including a vertical post 415 formed at its lower end with a pair of opposed ribs 417 receivable within slot 413 and permitting the post to be moved along the slot.

The upper end of post 415 is secured to one end of another horizontal arm 419. The opposite end of arm 419 carries a vertical pin 421 receivable within an axial bore 423 formed centrally through the rotary deflector 410. A cap 425 is applied to the upper end of pin 421 to limit the outward movement of the deflector 410 when impinged by the water jet from nozzle head 402. In addition, the juncture between horizontal arm 419 and vertical pin 420 is of conical shape, as shown at 427, with the apex of the cone facing downwardly over nozzle head 402.

FIG. 9 illustrates the operation of the sprinkler shown in FIG. 8. Thus, vertical post 415 may be adjusted along slot 413 so as to locate the rotary axis (i.e. stem 421) of the deflector at the desired position with respect to the nozzle bore 404. In this case, conical juncture 427 serves the same function as the conical apex at the underface of the deflector in the previously described embodiments, of deflecting the water to the grooves 416 formed in the underface of the deflector. Conical juncture 427 serves the an additional function of preventing the water from entering bore 423 receiving the deflector stem 421, as shown in FIG. 9.

It will be appreciated that the construction illustrated in FIGS. 8 and 9 operates in the same maner as described above, and permits the sprinkler to be pre-set with respect to the nozzle to produce a water distribution pattern either of a full circle or of a predetermined sector as described above.

FIG. 10 illustrates a still further variation in the construction of the adjustable mounting for the rotary deflector (not shown). In the variation illustrated in FIG. 10, the vertical pin 521, constituting the rotary axis of the deflector, is presettable around the circumference of the nozzle head 502, rather than in a radial direction with respect to the nozzle head. Thus, the supporting member 502 is fixed to and surrounds the nozzle 504 and is provided with an annular seat 505 slidably supporting the mounting member for the rotary deflector. The mounting member includes a vertical pin 521 carried by a horizontal ring 511 of annular configuration received within the annular seat 505 formed in the supporting member 502 so as to permit ring 511 to slidably rotate on seat 505 in order to preset the position of pin 521 with respect to the nozzle bore 504. Pin 521 is fixed to a vertical post 515 integrally formed with mounting ring 511 and is carried eccentrically of the ring by a horizontal arm 519.

FIG. 10*a* illustrates different preset positions of the rotary axis of the deflector with respect to the nozzle bore 504 which may be provided by rotating mounting ring 511 on seat 505. Thus, by rotating ring 511 circumferentially of seat 505, the rotary axis of the deflector, as defined by the conical apex 529, may be moved further from or closer to the axis of the nozzle bore 504, as shown at **529*a*, 529*b* and 529*c*, respectively. It will be appreciated that the farthest-away position 529*c* of the rotary axis of the deflector, with respect to the nozzle bore 504**, will produce a water distribution pattern covering the smallest sector arc.

FIG. 11 diagrammatically illustrates a variation wherein the horizontal arm, therein designated 619, for supporting the lower end of the vertical pin (521) rotatably mounting the deflector, is given a shaped, curved outer configuration so as to provide a hydrodynamic surface for the flow of the water after impinged by the apex (529). This shaped surface eliminates, or minimizes, the interruption that would otherwise be produced in the water deflected laterally of the sprinkler and impinged by the horizontal arm (519) and the vertical post (515).

What is claimed is:

1. A sprinkler comprising:

a nozzle head connectable to a source of pressurized water and including a nozzle bore through which the water issues in the form of a jet;

a rotary deflector having an underface formed with a radial array of grooves each having axially-extending inlet ends, radially-extending outlet ends, curved junctures joining the two ends, and curved bottom faces, which grooves are impinged by the water jet and deflect the jet laterally of the sprinkler while rotating the deflector;

a supporting member fixed with respect to said nozzle head;

and a mounting member carrying said rotary deflector and slidable along said supporting member for positioning the rotary deflector with its rotary axis at a large number of different positions with respect to the axis of the nozzle bore, to vary the water distribution pattern produced by the rotary deflector laterally of the sprinkler;

said supporting member comprising a bridge secured to said nozzle head and having a horizontal arm overlying the nozzle, said arm being formed with a slot slidably receiving said mounting member carrying said rotary deflector.

2. The sprinkler according to claim 1, wherein said radial array of grooves formed on the underface of said rotary deflector are non-symmetrical with respect to the rotary axis of the deflector.

3. The sprinkler according to claim 1, wherein said radial array of grooves formed on the underface of said rotary deflector are symmetrical with respect to the rotary axis of the deflector.

4. The sprinkler according to claim 1, wherein said grooves are all of the same configuration and dimensions.

5. The sprinkler according to claim 1, wherein said grooves are of different configurations and/or dimensions.

6. The sprinkler according to claim 1, wherein said first-mentioned horizontal arm is hydrodynamically shaped to eliminate or minimize the interruption of the laterally-directed jet when impinging against said arm.

7. A sprinkler comprising:

a nozzle head connectable to a source of pressurized water and including a nozzle bore through which the water issues in the form of a jet;

a rotary deflector having an underface formed with a radial array of grooves each having an axially-extending inlet end, a radially-extending outlet end, a curved juncture joining the two ends, and a curved bottom face, which grooves are impinged by the water jet and deflect the jet laterally of the sprinkler while rotating the deflector;

a supporting member with respect to said nozzle head;

and a mounting member carrying said rotary deflector and slidable along said supporting member for positioning the rotary deflector with its rotary axis at a large number of different positions with respect to the axis of the nozzle bore, to vary the water distribution pattern produced by the rotary deflector laterally of the sprinkler;

said mounting member comprising:

a vertical post laterally of the nozzle bore and slidable along said supporting member;

a horizontal arm secured at one end to the upper end of said vertical post to overlie the nozzle bore;

a vertical pin secured to the opposite end of said horizontal arm;

and a juncture between said horizontal arm and said vertical pin, said juncture being of conical configuration having its apex oriented towards said nozzle bore.

8. The sprinkler according to claim 7, wherein said vertical post is carried by a second horizontal arm laterally of the nozzle and is slidable on said supporting member in the radial direction with respect to the nozzle bore.

9. The sprinkler according to claim 7, wherein said vertical post is carried by a second horizontal arm laterally of the nozzle and is slidable on said supporting member in the circumferential direction with respect to the nozzle bore.

10. A sprinkler comprising:

a nozzle head connectable to a source of pressurized water and including a nozzle bore through which the water issues in the form of a jet;

a rotary deflector having an underface formed with a radial array of grooves each having axially-extending inlet ends, radially-extending outlet ends, curved junctures joining the two ends, and curved bottom faces, which grooves are impinged by the water jet and deflect the jet laterally of the sprinkler while rotating the deflector;

and mounting means mounting said rotary deflector, comprising:

a vertical post carried by said nozzle laterally of the nozzle bore;

a horizontal arm secured at one end to the upper end of said vertical post to overlie the nozzle bore;

a vertical pin secured to the opposite end of said horizontal arm;

and a juncture between said horizontal arm and said vertical pin, said juncture being of conical configuration having its apex oriented towards said nozzle bore;

said vertical post being carried by a second horizontal arm laterally of the nozzle and adjustable in the radial direction with respect to the nozzle.

11. The sprinkler according to claim 10, wherein said first-mentioned horizontal arm is hydrodynamically shaped to eliminate or minimize the interruption of the laterally-directed jet when impinging against said arm.

12. The sprinkler according to claim 10, wherein said radial array of grooves formed on the underface of said rotary deflector are non-symmetrical with respect to the rotary axis of the deflector.

13. The sprinkler according to claim 10, wherein said radial array of grooves formed on the underface of said rotary deflector are symmetrical with respect to the rotary axis of the deflector.

14. The sprinkler according to claim 10 wherein, said grooves are all of the same configuration and dimensions.

15. The sprinkler according to claim 10, wherein, said grooves are of different configurations and/or dimensions.

* * * * *